United States Patent [19]

Flagg

[11] 4,298,197

[45] Nov. 3, 1981

[54] BALANCE ASSIST FOR ROTATING RECREATIONAL DEVICES

[76] Inventor: Rodger H. Flagg, 1415 Lynn Ave., Fort Wayne, Ind. 46805

[21] Appl. No.: 7,399

[22] Filed: Jan. 29, 1979

[51] Int. Cl.[3] ..... A63B 19/02

[52] U.S. Cl. ..... 272/115

[58] Field of Search ..... 273/26 A, DIG. 19; 272/1 B, 1 E, 33 R, 33 A, 78, 115, 75; 9/2 A, 11 A, 310 R, 310 C, 310 F, 310 G; 115/1 R, 20–23; 280/206; 440/100

[56] References Cited

U.S. PATENT DOCUMENTS

| | | | |
|---|---|---|---|
| 1,564,313 | 12/1925 | Alger | 272/1 B |
| 1,753,310 | 4/1930 | Costello | 272/78 |
| 2,838,002 | 6/1958 | Wilson | 272/1 B X |
| 2,938,727 | 5/1960 | Nosak | 272/1 B X |
| 3,157,961 | 11/1964 | Payne | 273/DIG. 19 |
| 3,197,202 | 7/1965 | Tieman | 272/33 R |
| 3,342,482 | 9/1967 | Paolone | 273/DIG. 19 |
| 3,428,015 | 2/1969 | Cloud | 115/1 R |
| 3,652,090 | 3/1972 | Semmens | 272/1 B X |
| 3,709,491 | 1/1973 | Minchin | 272/78 X |
| 4,054,961 | 10/1977 | Tangen | 9/11 A |

FOREIGN PATENT DOCUMENTS

| | | | |
|---|---|---|---|
| 500989 | 2/1939 | United Kingdom | 272/1 B |

*Primary Examiner*—Richard J. Apley
*Attorney, Agent, or Firm*—Rodger H. Flagg

[57] ABSTRACT

This invention relates to a balance assist for rotating recreational devices of the type wherein the user effects rotation of the recreational device by walking or pacing within the device. The balance assist includes a flexible hand grip rotatably supported in a bracket, suspended by a plurality of straps, and secured to the outer diameter of the recreational device. A tension adjustment means is provided to compensate for expansion and contraction of inflatable recreational devices, and to approximately center the balance assist bracket. The balance assist may be used on one or both sides of the recreational device.

16 Claims, 3 Drawing Figures

BALANCE ASSIST FOR ROTATING RECREATIONAL DEVICES

BACKGROUND OF THE INVENTION

This application is related to my patent application Ser. No. 700,395 filed June 28, 1976, entitled, "RECREATIONAL DEVICE," now U.S. Pat. No. 4,154,188.

Rotating recreational devices, such as the aforementioned patent application, require a combination of skills including balance, pacing, and stamina, to efficiently maneuver the device over a variety of terrain. It has been found in actual tests, that beginners at first have difficulty mastering the various skills required to effect continued use of the device, until they develop these skills in combination. To assist beginners in the operation and use of such devices, it has been found that by providing a convenient means of balance assist, an operator who might fall after his first few steps, is able to traverse with confidence a far greater distance. Once the combined skills have been acquired, such balance assist means are no longer required, and the user is fully capable of traversing large bodies of land or water without the use of this device.

Just as training wheels assist the development of skills required to ride a bicycle, so this balance assist aids training in the use of recreational devices that rotate about the user. Thus, the present invention positions a stable gripping means near the center of the diameter of the rotating recreational device, where it is readily grasped by the user, whether he is short or tall. He need not release his grip on the gripping means as the recreational device rotates. He is free to move to one side or the other within the recreational device to effect a turning motion on the recreational device without having to release his grip on the balance assist.

SUMMARY OF THE INVENTION

Therefore, one object of this invention is to provide an economical means to assist the user in maintaining his balance while operating a rotating recreational device.

Another object of this invention is to provide a safe and yielding means of balance assist which does not interfere with the user as he operates such devices.

Another object of this invention is to provide a balance assist suspended near the axis of rotation which provides a flexible gripping surface to assist the balance of the user, which does not rotate in accompaniment to the rotation of the recreational device.

Another object of this invention is to provide an adjustable balance assist which may readily be retrofitted to existing rotating recreational devices.

Another object of this invention is to provide a means to suspend the balance assist in the area of the axis of rotation at the outer limits of the rotating device to provide freedom of movement within the device to control and maneuver the rotating recreational device.

Yet another object of this invention is to provide a balance assist which allows entry or exit between the straps suspending the balance assist and the rotating recreational device.

Still another object of this invention is to provide a flexible gripping surface that follows the articulate movement of the user's hand as he varies positions within the rotating recreational device.

These and other objects will be apparent to the reader as he reviews the following specification and claims.

DEFINITIONS

Figure 1:
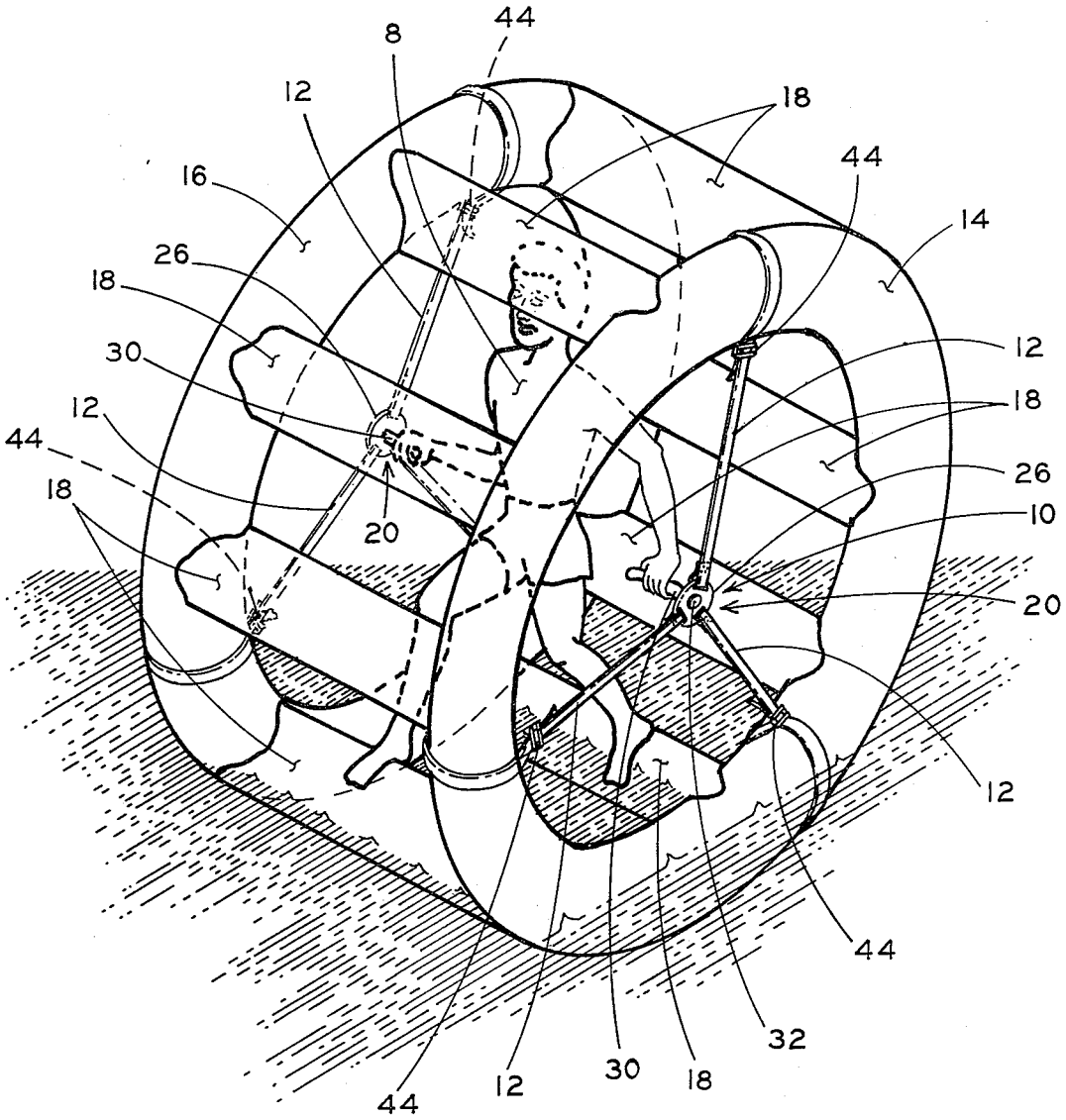
FIG. 1 is a perspective view of one such recreational device, showing the balance assist attached to the annular rings and positioned to provide a gripping means in the vicinity of the center of the annular rings.
Figure 2:
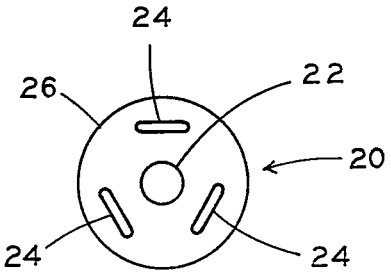
FIG. 2 is a view of the central hub prior to assembly of the straps and gripping means.

Flexible: For purposes of this application, flexible is intended to be limited in scope to mean easily bent, pliable, soft, not stiff or tending to return to its original position when bent; such as a short length of rope.

DETAILED DESCRIPTION OF THE INVENTION

The balance assist, designated generally by the reference numeral 10, comprises straps 12 of a length sufficient to span from the annular rings 14,16 to the center of each annular ring where a central hub 20 is suspended. Central hub 20 includes an opening 22 through which gripping means 30 may be rotatably mounted. Straps 12 may be readily secured to the central hub 20 by means of openings 24 through which straps 12 may pass. The balance assist gripping means 30 has on one end an enlarged portion 32 to restrict passage of the enlarged portion 32 through opening 22 in the central hub 20. Gripping means 30 must be of a length sufficient to allow the user within the recreational device to maintain a grip on the flexible gripping means while operating the recreational device, to assist balance within such device by pulling on gripping means 30 when required to maintain balance.

Straps 12 are preferred over ropes, line, rod, tube, or other devices which would tend to be rigid or otherwise bruise or cut the user should they fall against any portion of the balance assist.

For the same reasons, it is important that the central hub 20 of the balance assist does not contain sharp or abrasive edges that might injure the user.

Figure 3:
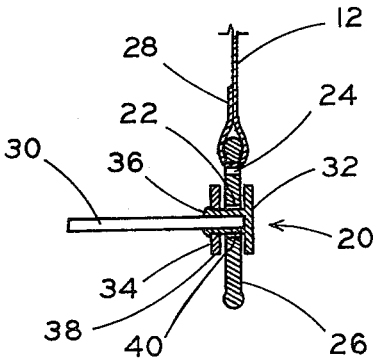
FIG. 3 is an enlarged, cross-sectional view of the central hub of the balance assist showing the means for mounting the straps and gripping means within the central hub.

Since gripping means 30 is allowed to freely rotate within opening 22 of central hub 20 of the balance assist 10, the user may securely grip item 30 and maintain his grip without worry of twisting or kinking the gripping means 30 as the recreational device rotates in use. The flexible gripping means will readily adapt to the desired articulated position of the user's grip. Since the balance assist provides a means to maintain balance by pulling on gripping means 30 to correct and maintain balance within the rotating device, it is not essential that gripping means 30 be permanently rotatably secured within central hub 20 of the balance assist. However, to avoid inadvertent loss of gripping means 30, (FIG. 3) flange 34 is employed with a central opening 36 of a size sufficient to pass over gripping means 30 and whose outer dimensions 38 are greater than opening 22 in the central hub 20 of the balance assist 10. Flange 34 secures gripping means 30 rotatably within central hub 20 to avoid loss.

Gripping means 30 is fabricated from a short length of rope or other soft or pliable material which will not cause injury to the user should he fall against the gripping means. A short section of flexible rope or the like 30, is preferred, yet it is important that the gripping means not be sufficiently long that it can be wrapped about the user's hand in a way that may entrap the user's hand in the balance assist should the user fall.

A sleeve 40 may cover gripping means 30 at one end, and extend from end 32 or flange 34, and be of an external diameter to freely rotate within opening 22. Sleeve 40 would thus provide a bearing surface between gripping means 30 and opening 22 of the central hub 20 of balance assist 10.

All materials used in fabricating the balance assist should be non-corrodable and preferably made of flexible material or plastic, which will not be adversely affected by continued contact with sunlight or fresh salt water.

Straps 12 may be passed through openings 24 in central hub 20 of balance assist 10, and the portion passing through opening 24 may be turned back against strap 12 and permanently secured by riveting, stitching, snap fastening, or other conventional fastening means; or may be adjustably secured by a buckle or other conventional adjustable means. Opposite ends of straps 12 may pass around the outer circumference of annular rings 14,16 between cross tubes 18. The end of strap 12 that passes around the annular ring may be fixedly or slideably secured to strap 12 by buckle 44 to provide a means of securement of the balance assist 10 to the annular rings 14,16. Strap 12 tightens against the inflated rings 14,16 to restrict lateral slippage.

Because the balance assist is considered a temporary means to help the user develop the skills required to operate the recreational device, it is preferred that the balance assist be made readily removable.

Some adjustment is desirable to maintain tension of the balance assist when secured to the annular rings. Thus, in the preferred embodiment, one end of strap 12 passes through opening 24 in the central hub 20 of balance assist 10 and is turned back and secured to strap 12.

The opposite end of strap 12 is passed around the circumference of annular ring 14,16 and a means such as buckle 44 is provided to adjustably secure strap 12 thereto while maintaining tension to support the central hub 20 in the approximate center of the axis of rotation near the outer envelope of the recreational device.

In the preferred embodiment, 3 straps are used, approximately 120° apart. This allows free access through the sector between the straps and the outer envelope from each side of the recreational device.

It is anticipated that a new user would begin with the aid of a balance assist 10 located on each side of the recreational device, as he stands within the device, as shown in FIG. 1. Thus, by gripping one or the other of flexible gripping means 30, he may maintain his balance to either side as well as forwardly and rearwardly. As his skills of balance and pacing improve, one such balance assist could readily be removed. As his skills of balance and pacing continue to increase, it is anticipated that all balance assists will be removed and he will freely operate the device without need of a balance assist.

However, where rough or choppy waters are anticipated, or long distances of water are to be traveled, even a skilled user may elect to use one or both balance assists. It is understood that more than three straps 12 may be employed to suspend the central portion 20 in the approximate center of annular rings 14,16.

This balance assist is believed to be useful on other devices where a balance assist is desired, and the device rotates about the user.

It is further understood that a means may be readily provided upon the annular rings 14,16 which would receive and secure straps 12 without requiring that they extend around the circumference of the annular ring. This is well within the scope of one skilled in the art to adapt such a fastening.

OPERATION OF THE INVENTION

The balance assist 10 is suspended from the annular rings 14 or 16 by straps 12 which serve to position central hub 20 in the approximate center of an annular ring. A tensioning means 44 is provided to position and maintain central hub 20 in the approximate center of the annular ring. Where annular rings are made inflatable, it is understood that the air within the inflatable annular ring expands as the air is heated, which changes to some extent the overall circumference of the annular ring, so that an adjusting means for the length of strap 12 is preferred. Once balance assist 10 is positioned and secured with central hub 20 located in the approximate center of the annular ring, the user enters the recreational device, takes the flexible gripping means 30 in his hand, and begins rotating the recreational device by stepping sequentially from one cross member 18 to the next. As the user steps from cross member to cross member, the device is caused to rotate about the user, providing a perpetual stepping place. Gripping means 30 provides a balance assist to the user in his walking and pacing efforts and serves to assist in the correction of any imbalance on behalf of the user. The user pulls on gripping means 30 to correct his imbalance and thus maintain control of the recreational device.

Should the user fall, his hand readily disengages from gripping means 30, and his hand is in no way restrained as the user falls. Should the user fall against the balance assist, his fall will not cause injury to the user by sharp or unyielding surfaces.

The user has ready access to the recreational device through the sector between the straps and the outer envelope of the recreational device.

As the recreational device rotates about the user in accompaniment to his sequentially stepping from cross member 18 to cross member 18, the gripping means 30 does not become entangled by the rotating movement of the recreational device, but remains a stable, non-rotating, flexible gripping means, to assist the balance of the user.

The rotational movement of the recreational device is not transmitted to the gripping surface 30 due to the free rotation of the gripping surface 30 within opening 22 in the central hub 20 of the balance assist 10.

Maneuverability of rotating recreational devices requires a change of position of the user within the device to effect the turning of the device. This results in the user favoring one side or the other within the rotating recreational device to effect a turning motion of the device. This balance assist provides a ready means for the change of position of the user within the device without requiring that he let loose of the gripping means. The balance assist is available to large or small users, and is positioned near the center of the axis of rotation of the rotating device where the user may conveniently maintain his grip without difficulty as he maneuvers within the envelope of the recreational device.

Although the present invention has been illustrated and described in connection with a few selected example embodiments, it will be understood that these are illustrative of the invention and are by no means restrictive thereof. It is reasonably to be expected that those skilled in this art can make numerous revisions and adaptations of the invention, and it is intended that such revisions and adaptations will be included within the scope of the following claims.

What is claimed is:

1. A removable apparatus to assist the balance of a user within a rotatable self-propelled recreational device having a pair of parallel coaxial rings supported in axially spaced relation to one another comprising:

a hub adapted to be positioned centrally at the axis of one of said rings;

gripping means being freely rotatably mounted to said hub; said gripping means being adapted for manual grasping by a user positioned between said rings to provide balance during propelling of the device, as the ring is being rotated about its axis;

a plurality of elongated members, each member being attached at one of its ends to said hub;

attaching means for removable attaching each of the other ends of each of said members to said rings in member tensioned condition to position and tensionally support said hub centrally of said one ring.

2. The apparatus of claim 1 wherein the said hub has a central opening; said gripping means comprises a soft, pliable, elongated handle having one end extending through said central opening and rotatably mounted therein; the other end of said handle being disposed inwardly of said pair of rings; said handle having adequate length for ready manual grasping by the user, said length being limited to prevent interference with rotation of said rings and to prevent entanglement of user limb extremity during use; said handle being sufficiently pliable to prevent user injury during use and forcible thrusting against the body of the user during an unbalanced fall against the handle.

3. The apparatus of claim 2 including a sleeve secured to said one handle end; said sleeve being freely rotatably mounted in said hub opening to provide a bearing surface freely rotatable in said opening.

4. The apparatus of claim 3 including a pair of spaced flanges attached to said sleeve, one flange being on either side of said hub, to prevent inadvertent axial removal of said sleeve from said hub.

5. The apparatus of claim 1 wherein said members are flexible; said attaching means comprises a tension buckle on each member for slidably receiving said other end of its respective member after said other end has been looped about the one ring, until a desired tension is obtained in the member and to releasably maintain said tension in said members.

6. The apparatus of claim 1 wherein said plurality of members comprise three members equiangularly spaced about said hub to form three 120° angular spacings between said members, said angular spacings providing ready user entry to and egress from a user operational position between said rings.

7. The apparatus of claims 1, 5, or 6 wherein said members comprise flexible straps.

8. The method of using a hub having a plurality of elongated members, each member being attached at one end to the hub, and a resiliently mounted handle freely rotatably mounted centrally of the hub, comprising the steps of positioning the hub within a first ring of a self propelled recreational device having a pair of first and second coaxial tubular rings supported in axially spaced relation to one another, with the handle facing axially inwardly between said rings for manual grasping by a user positioned between said rings;

attaching the other end of each of said members to the first ring;

tensioning each of said members to position and tensionally support the hub substantially centrally of the first ring.

9. The method of claim 8 wherein there are three members substantially equiangularly spaced about said first ring wherein the step of attaching the other end of each of said members to the hub forms three 120° angular spacings between said members, said angular spacings providing ready user entry to and egress from a user operational position between said rings.

10. The method of claims 8 or 9 wherein each member is a flexible strap and has a tensioning buckle positioned adjacent said other member end, the steps of attaching and tensioning said members comprises looping each member end over said first ring, training each of said other ends through its respective buckle, and pulling said other end until the desired tension is obtained in each of said members.

11. The method of claims 8 or 9 for using a second hub having a plurality of elongated members, each member attached at one end to the second hub, and a handle rotatably mounted centrally of said second hub, comprising the additional steps of positioning the second hub within the second ring, attaching the other end of each of the second hub members to the second ring with the second hub handle facing inwardly between the rings, and tensioning each of said second hub members to position and tensionally support the second hub substantially centrally of the second ring.

12. A self propelled recreational apparatus comprising;

a pair of parallel, coaxial, axially spaced resilient rings;

a plurality of axially parallel cross members being between said rings and each member being attached at opposite ends to said rings; said members being in circumferentially spaced positions about the perimeter of said rings to support said rings in said axially spaced coaxial relation, and to provide pedal engagement by the user to propel the apparatus;

a hub adapted to be positioned centrally at the axis of one of said rings;

a plurality of elongated members, one end of said members being attached to said hub;

gripping means being freely rotatably mounted to said hub, said gripping means being adapted for manual grasping by a user positioned between said rings to provide balance during propelling of said apparatus as the rings are being rotated;

means for attaching the other ends of each of said members to said rings in member tensioned condition to position and tensionally and resiliently support said hub centrally of said one ring.

13. The apparatus of claim 12 wherein the said hub has a central opening; said gripping means comprises a soft, pliable, elongated handle having one end extending through said central opening and rotatably mounted therein; the other end of said handle being disposed inwardly of said pair of rings; said handle having adequate length for ready manual grasping by the user, said length being limited to prevent interference with rotation of said rings and to prevent entanglement of user limb extremity during use; said handle being sufficiently pliable to prevent user injury during use and forcible thrusting against the body of the user during an unbalanced fall against the handle.

14. The apparatus of claim 12 wherein said members are flexible; said attaching means comprises a tension buckle on each member for slidably receiving said other end of its respective member after said other end has been looped about the one ring, until a desired tension is obtained in the member and to releasably maintain said tension in said members.

15. The apparatus of claim 12 wherein said plurality of members comprise three members equiangularly spaced about said hub to form three 120° angular spacings between said members, said angular spacings providing ready user entry to and egress from a user operational position between said rings.

16. The apparatus of claim 12, 13, 14, or 15 including a second hub having a rotatably mounted gripping means and a plurality of elongated members each having attaching and tensioning means, said second hub being positioned within and attached to said second ring to provide a pair of substantially coaxially mounted facing gripping means for providing support and balance for a user positioned between said rings, said gripping means providing support and balance for a user positioned between said rings, a first gripping means providing for manual grasping by one hand of the user and the second gripping means providing for manual grasping by the other hand of the user.

* * * * *